US006390550B1

(12) United States Patent
Paredes, Jr. et al.

(10) Patent No.: US 6,390,550 B1
(45) Date of Patent: May 21, 2002

(54) PERSONAL HYGIENE SEAT ASSEMBLY

(76) Inventors: Joe Paredes, Jr.; Debra D. Paredes, both of 6223 Harrison, Kansas City, MO (US) 64110

( * ) Notice: Subject to any disclaimer, the term of this patent is extended or adjusted under 35 U.S.C. 154(b) by 0 days.

(21) Appl. No.: 09/675,169

(22) Filed: Sep. 29, 2000

(51) Int. Cl.[7] ..... A47C 1/10; A47C 4/00

(52) U.S. Cl. ..... 297/250.1; 297/17; 297/219.1; 297/228.12; 297/423.28; 297/423.31; 297/423.32; 297/423.35; 297/452.41

(58) Field of Search ..... 297/17, 219.1, 297/228.12, 250.1, 423.28, 423.31, 423.32, 423.35, 452.41

(56) References Cited

U.S. PATENT DOCUMENTS

| | | | | | |
|---|---|---|---|---|---|
| 820,125 | A | * | 5/1906 | Pennington | 297/54 |
| 2,308,315 | A | * | 1/1943 | Smith | 297/256.13 |
| 2,474,572 | A | * | 6/1949 | Brose et al. | 4/523 |
| 2,767,408 | A | * | 10/1956 | Reibman | 4/239 |
| 2,951,531 | A | * | 9/1960 | Dantes | 297/182 |
| 3,179,465 | A | * | 4/1965 | Roberts | 297/17 |
| 3,697,127 | A | * | 10/1972 | Robertson | 297/182 |
| 3,810,673 | A | | 5/1974 | Shoji | |
| 3,879,085 | A | | 4/1975 | Morel | |
| 4,180,062 | A | * | 12/1979 | Alberti et al. | 600/511 |
| 4,240,662 | A | * | 12/1980 | Anderson | 297/17 |
| 4,255,823 | A | * | 3/1981 | Boyer et al. | 5/87.1 |
| D267,599 | S | | 1/1983 | Fator | |
| 4,527,829 | A | * | 7/1985 | Fanslau et al. | 297/17 |
| 4,841,584 | A | | 6/1989 | Overrcash et al. | |
| 5,121,961 | A | * | 6/1992 | Marshall | 297/17 |
| 5,144,701 | A | | 9/1992 | Clark | |
| 5,294,171 | A | * | 3/1994 | Horng | 297/38 |
| 5,297,300 | A | * | 3/1994 | Sheu | 4/572.1 |
| 5,370,439 | A | * | 12/1994 | Lowe et al. | 297/180.11 |
| 5,505,524 | A | * | 4/1996 | Drumwright | 297/440.24 |
| 5,509,155 | A | * | 4/1996 | Zigarac et al. | 5/655.3 |
| 5,516,188 | A | * | 5/1996 | Bruhnke et al. | 297/129 |
| 5,940,900 | A | * | 8/1999 | Wells | 4/515 |

FOREIGN PATENT DOCUMENTS

EP 0490130 A1 * 11/1991

* cited by examiner

*Primary Examiner*—Peter M. Cuomo
*Assistant Examiner*—Joseph Edell

(57) ABSTRACT

A personal hygiene seat assembly for providing a comfortable and stable reclined seat assembly for performing personal hygiene needs such as shampooing and shaving of the elderly of handicapped at home using a conventional sink. The personal hygiene seat assembly includes a base member designed for removably coupling to a seat portion of a chair, a back member hingedly coupled to the base member, and a seat member having a bottom portion coupled to the base member and designed for supporting a person sitting on the personal hygiene seat assembly, the seat member further has a backing portion coupled to the back member and designed for supporting a back of the person using the personal hygiene seat assembly when the person is in a reclined position.

17 Claims, 5 Drawing Sheets

PERSONAL HYGIENE SEAT ASSEMBLY

BACKGROUND OF THE INVENTION

1. Field of the Invention

The present invention relates to shampoo stations and more particularly pertains to a new personal hygiene seat assembly for providing a comfortable and stable reclined seat assembly for performing personal hygiene needs such a shampooing and shaving of the elderly or handicapped at home using a conventional sink.

2. Description of the Prior Art

The use of shampoo stations is known in the prior art. More specifically, shampoo stations heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,841,548; U.S. Pat. No. 3,879,085; U.S. Pat. No. 5,144,701; U.S. Pat. No. 3,810,673; U.S. Pat. No. 5,294,171; and U.S. Pat. No. Des. 267,599.

While these devices fulfill their respective, particular objectives and requirements, the aforementioned patents do not disclose a new personal hygiene seat assembly. The inventive device includes a base member designed for removably coupling to a seat portion of a chair, a back member hingedly coupled to the base member, and a seat member having a bottom portion coupled to the base member and designed for supporting a person sitting on the personal hygiene seat assembly, the seat member further has a backing portion coupled to the back member and designed for supporting a back of the person using the personal hygiene seat assembly when the person is in a reclined position.

In these respects, the personal hygiene seat assembly according to the present invention substantially departs from the conventional concepts and designs of the prior art, and in so doing provides an apparatus primarily developed for the purpose of providing a comfortable and stable reclined seat assembly for performing personal hygiene needs such a shampooing and shaving of the elderly or handicapped at home using a conventional sink.

SUMMARY OF THE INVENTION

In view of the foregoing disadvantages inherent in the known types of shampoo stations now present in the prior art, the present invention provides a new personal hygiene seat assembly construction wherein the same can be utilized for providing a comfortable and stable reclined seat assembly for performing personal hygiene needs such a shampooing and shaving of the elderly or handicapped at home using a conventional sink.

The general purpose of the present invention, which will be described subsequently in greater detail, is to provide a new personal hygiene seat assembly apparatus and method which has many of the advantages of the shampoo stations mentioned heretofore and many novel features that result in a new personal hygiene seat assembly which is not anticipated, rendered obvious, suggested, or even implied by any of the prior art shampoo stations, either alone or in any combination thereof.

To attain this, the present invention generally comprises a base member designed for removably coupling to a seat portion of a chair, a back member hingedly coupled to the base member, and a seat member having a bottom portion coupled to the base member and designed for supporting a person sitting on the personal hygiene seat assembly, the seat member further has a backing portion coupled to the back member and designed for supporting a back of the person using the personal hygiene seat assembly when the person is in a reclined position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal hygiene seat assembly apparatus and method which has many of the advantages of the shampoo stations mentioned heretofore and many novel features that result in a new personal hygiene seat assembly which is not anticipated, rendered obvious, suggested, or even implied by any of the prior art shampoo stations, either alone or in any combination thereof.

It is another object of the present invention to provide a new personal hygiene seat assembly which may be easily and efficiently manufactured and marketed.

It is a further object of the present invention to provide a new personal hygiene seat assembly which is of a durable and reliable construction.

An even further object of the present invention is to provide a new personal hygiene seat assembly which is susceptible of a low cost of manufacture with regard to both materials and labor, and which accordingly is then susceptible of low prices of sale to the consuming public, thereby making such personal hygiene seat assembly economically available to the buying public.

Still yet another object of the present invention is to provide a new personal hygiene seat assembly which provides in the apparatuses and methods of the prior art some of the advantages thereof, while simultaneously overcoming some of the disadvantages normally associated therewith.

Still another object of the present invention is to provide a new personal hygiene seat assembly for providing a comfortable and stable reclined seat assembly for performing personal hygiene needs such a shampooing and shaving of the elderly or handicapped at home using a conventional sink.

Yet another object of the present invention is to provide a new personal hygiene seat assembly which includes a base member designed for removably coupling to a seat portion of a chair, a back member hingedly coupled to the base member, and a seat member having a bottom portion coupled to the base member and designed for supporting a person sitting on the personal hygiene seat assembly, the seat member further has a backing portion coupled to the back member and designed for supporting a back of the person using the personal hygiene seat assembly when the person is in a reclined position.

Still yet another object of the present invention is to provide a new personal hygiene seat assembly that folds for transporting and storing.

Even still another object of the present invention is to provide a new personal hygiene seat assembly that is adjustable for the height of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
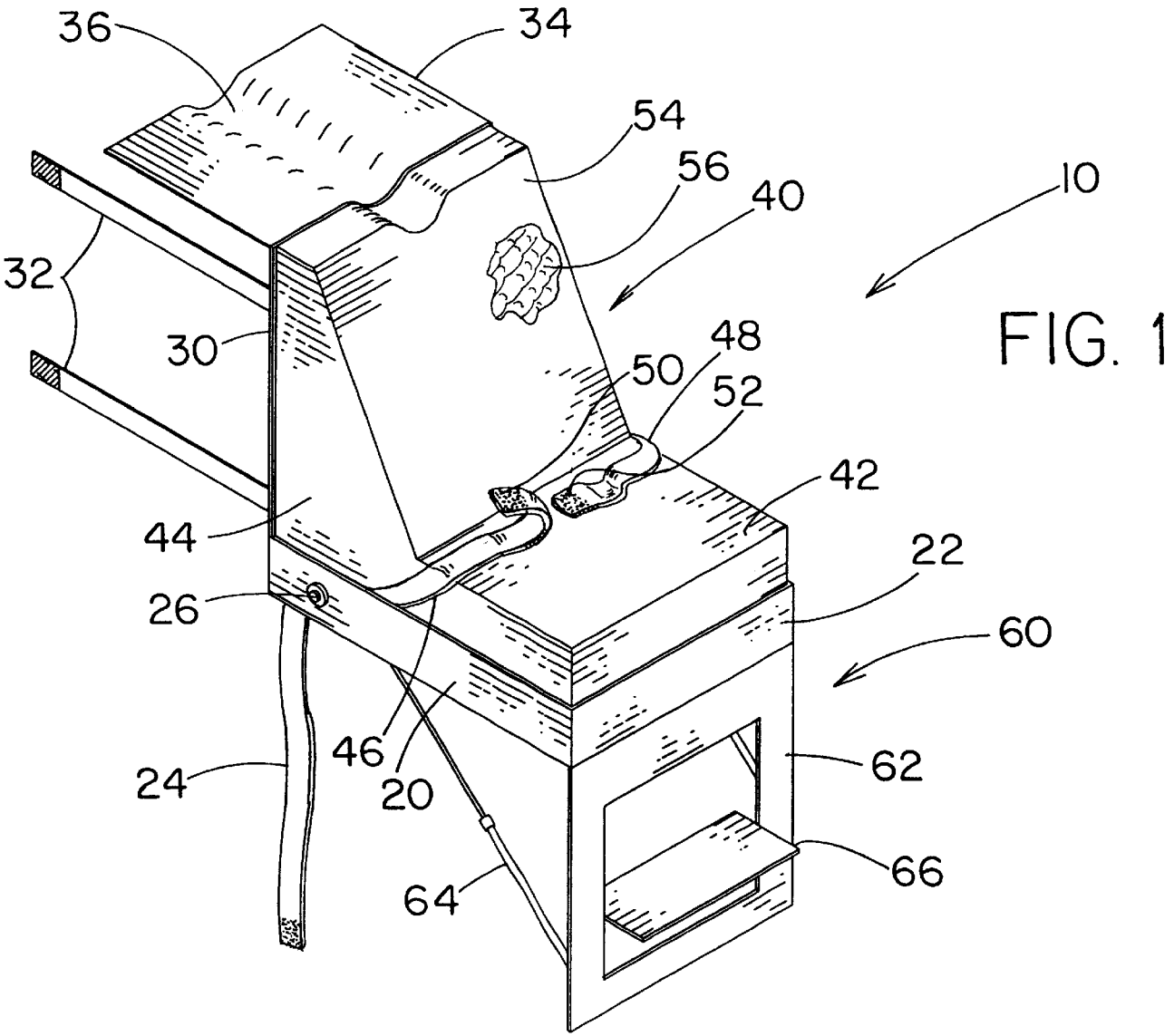
FIG. 1 is a schematic perspective view of a new personal hygiene seat assembly according to the present invention.
Figure 2:
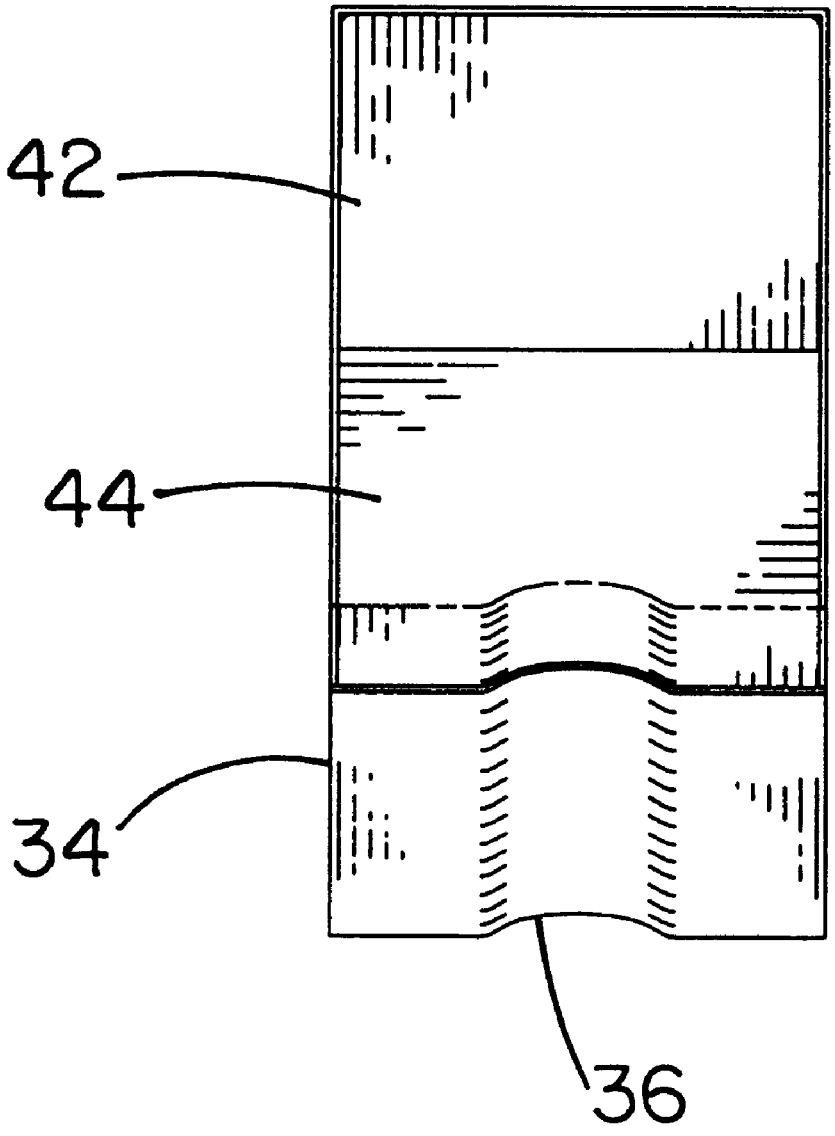
FIG. 2 is a schematic top view of the present invention.
Figure 3:
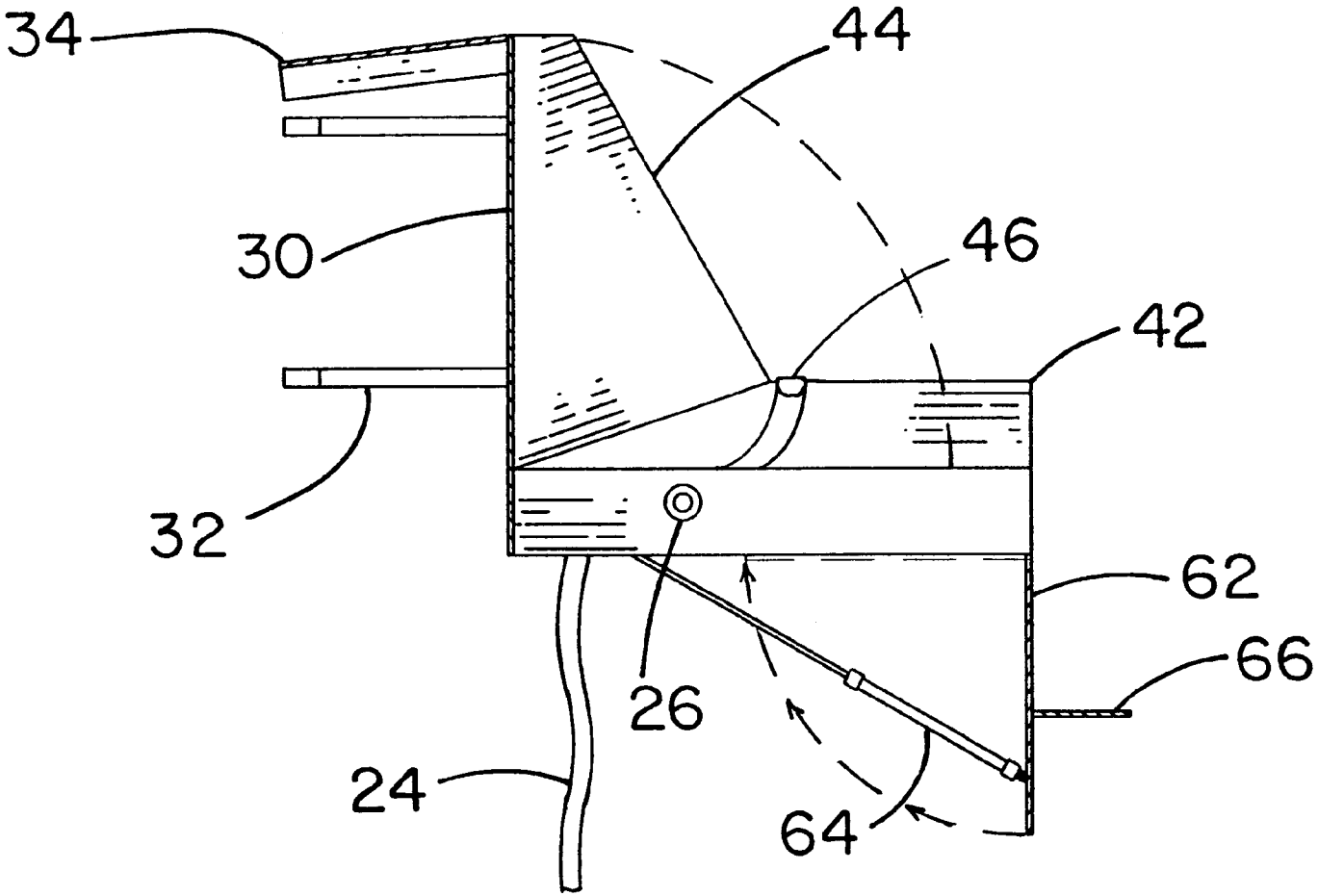
FIG. 3 is a schematic side view of the present invention.
Figure 4:
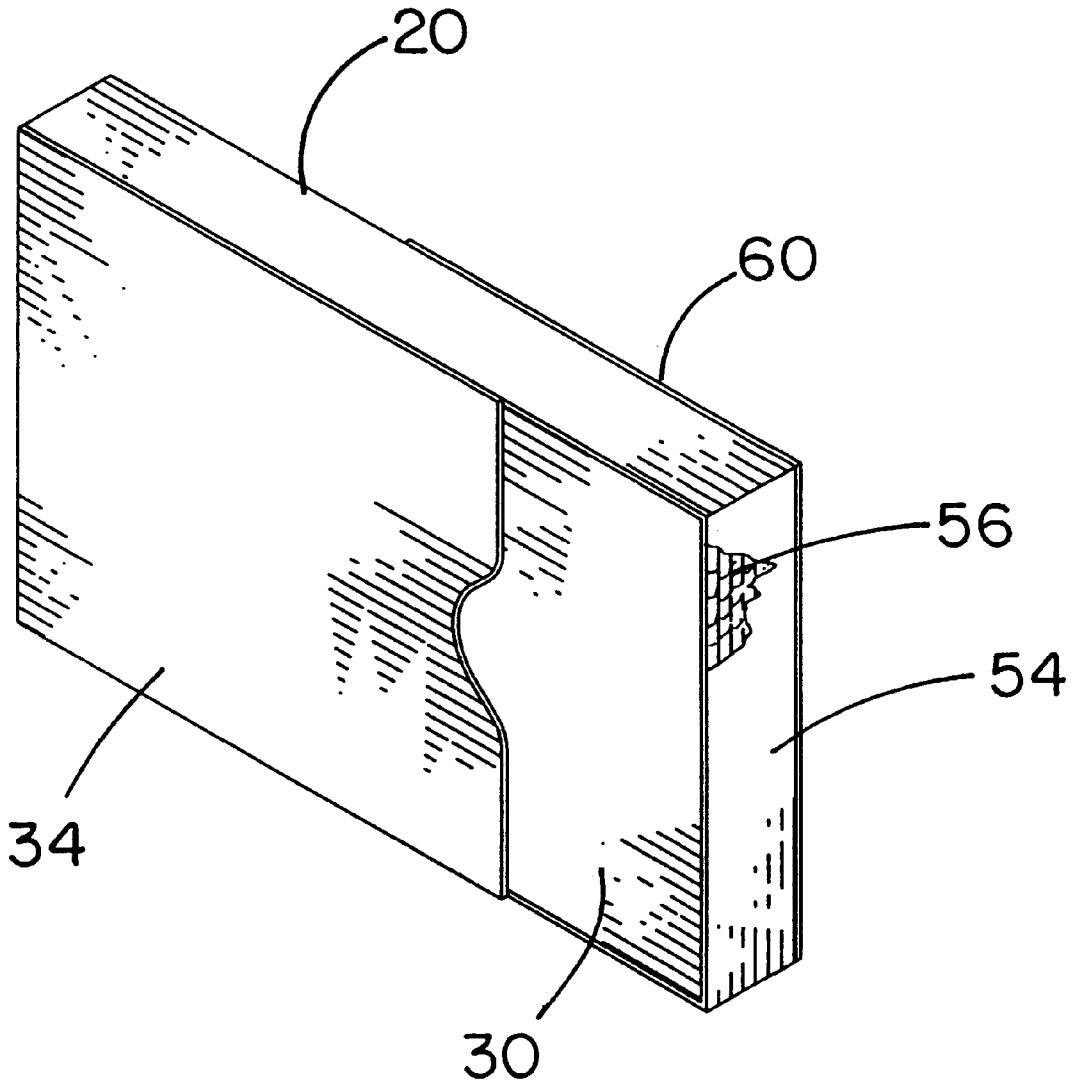
FIG. 4 is a schematic back view of the present invention in a folded condition.
Figure 5:
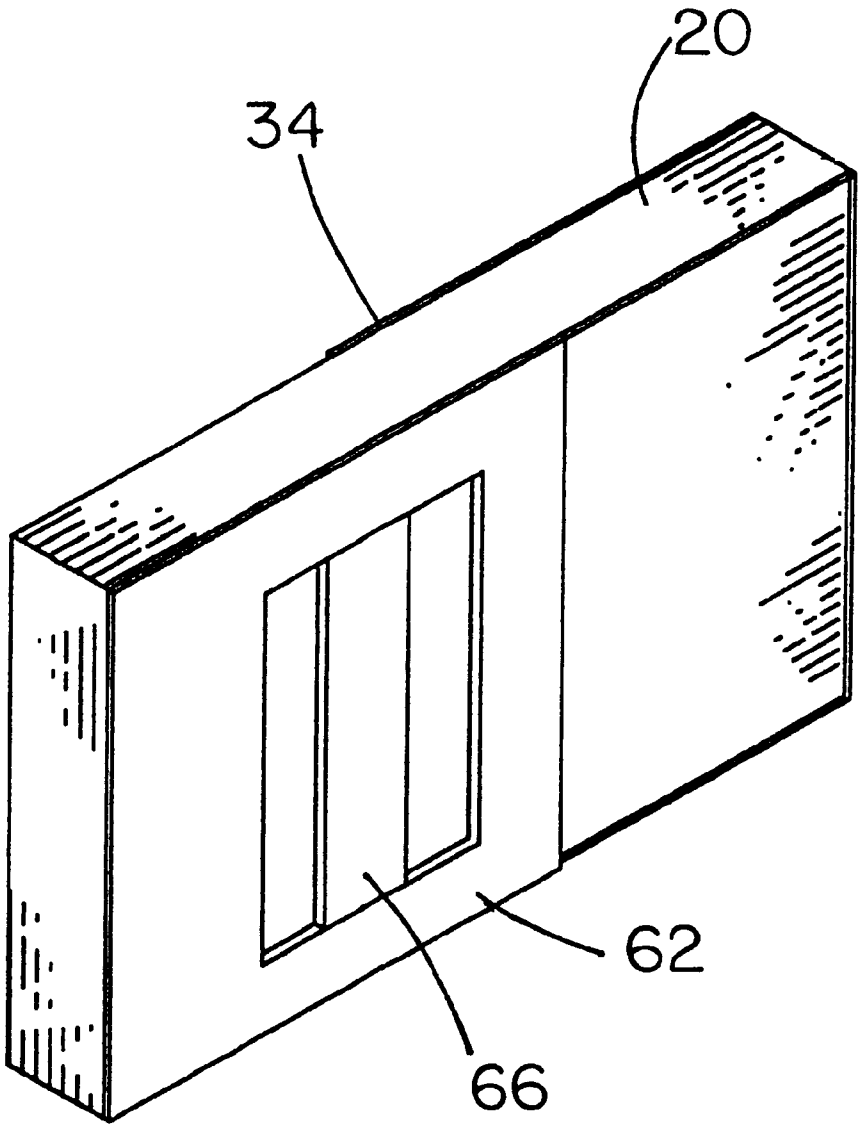
FIG. 5 is a schematic front view of the present invention in a folded condition.

With reference now to the drawings, and in particular to FIGS. 1 through 5 thereof, a new personal hygiene seat assembly embodying the principles and concepts of the present invention and generally designated by the reference numeral 10 will be described.

As best illustrated in FIGS. 1 through 5, the personal hygiene seat assembly 10 generally comprises a base member 20, a back member 30, and a seat member 40.

The base member 20 is designed for removably coupling to a seat portion of a chair.

The back member 30 is hingedly coupled to the base member 20.

The seat member 40 includes a bottom portion 42 and a backing portion 44. The bottom portion 42 is designed for supporting a person sitting on the personal hygiene seat assembly 10. The backing portion 44 is designed for supporting a back of the person using the personal hygiene seat assembly 10 when the person is in a reclined position. The backing portion 44 is coupled to the back member 30. The bottom portion 42 is coupled to the base member 20.

A leg support assembly 60 is hingedly coupled to a front edge 22 of the base member 20. The leg support assembly 60 is designed for supporting the legs of a user when the user is in a reclined position.

The leg support assembly 60 comprises a leg support frame 62, a pair of extension members 64, and a foot rest portion 66.

The leg support frame 62 is hingedly coupled to the front edge 22 of the base member 20. The leg support frame 62 is designed for supporting the legs of the user when the user is in a reclined position.

The pair of extension members 64 each includes a first end and a second end. The first end is pivotally coupled to an underside of the base member 20. The second end is pivotally coupled to a backside of the leg support frame 62. The pair of extension members 64 is for positioning the leg support frame 62 such that a plane defined by the leg support frame 62 is oriented at an oblique angle to a plane defined by the base member 20. The oblique angle is determinable by the user.

The foot rest portion 66 is pivotally coupled to the leg support frame 62 and designed for supporting the feet of a user when the user is in a seated or reclined position.

Each one of a plurality of rear strap members 32 includes a first end coupled to a first side of the back member 30. Each one of the rear strap members 32 includes a second end. Each second end is couplable to a second side of the back member 30 for coupling the back member 30 to a back portion of a seat such that the personal hygiene seat assembly 10 is prevented from sliding forward on the seat when the plurality of rear strap members 32 is placed around the back portion of the seat and coupled to the second side of the back member 30.

A bottom strap 24 includes a first end coupled to a first side of the base member 20. The bottom strap 24 includes a second end couplable to a second side of the base member 20. The bottom strap 24 is designed for fitting around a seat portion of a chair for preventing the personal hygiene seat assembly 10 from being lifted off of the chair when the bottom strap 24 is coupled to the second side of the base member 20.

A drainage member 34 includes a proximal edge and a distal edge. The proximal edge is hingedly coupled to a top edge of the back member 30 for facilitating the flow of water into a sink when the personal hygiene assembly 10 is placed adjacent to the sink.

The drainage member 34 further comprises a depression 36, which extends along a longitudinal axis of the drainage member 34. The depression 36 is designed for facilitating the flow of water into the sink. The depression 36 has a width substantially equivalent to the size of a human head.

The drainage member 34 further comprises a polymeric material for facilitating the flow of water and inhibiting the absorption of water by the drainage member 34.

A first seat belt member 46 includes a first end and a second end. The first end is coupled to a first side of the base member 20. The second end includes a first portion of hook and loop fastener 50 applied thereon.

A second seat belt member 48 includes a first end and a second end. The first end is coupled to a second side of the base member 20. The second end includes a second complementary portion of hook and loop fastener 52 applied thereon.

The first belt member 46 and second belt member 48 are designed for securing a user to the personal hygiene seat assembly 10 during use and preventing the user from slipping off of the seat assembly 10.

In one embodiment, the seat member 40 is inflatable for facilitating adjustment of the height of the seat member 40 to align a top of the seat member 40 with an edge of a sink. An air inlet valve 26 is positioned on a side of the base member 20. The air inlet valve 26 is in environmental communication with the inflatable seat member 40. The air inlet valve 26 is for controlling the quantity of air in the inflatable seat member 40 such that the height of the seat member 40 is controllable by adjusting the air inlet valve 26.

In an embodiment the seat member 40 comprises a cover portion 54 and a pad portion 56. The pad portion 56 comprises a foam rubber. The cover portion 54 envelops the pad portion 56. The cover portion 54 comprising a substantially waterproof material for repelling moisture.

In an embodiment the base member 20 includes a length of approximately 24 inches, a width of approximately 17 and ½ inches, and a thickness if approximately 4 inches.

In a further embodiment the backing portion 44 of the seat member 40 has a height of approximately 24 inches, the bottom portion 42 has a length of approximately 24 inches, the seat member 40 includes a width of approximately 17 and ½ inches, the seat member 40 includes a thickness of approximately 4 inches.

The drainage member 34 is foldable such that a bottom surface of the drainage member 34 abuts a back surface of the back member 30 when the drainage assembly 34 is in a folded position. The leg support assembly 60 is foldable such that a back surface of the leg support assembly 60 abuts a bottom surface of the base member 20 when the leg support assembly 60 is in a folded position. The back member 30 is foldable such that a front surface of the backing portion 44 abuts a top surface of the bottom portion 42 when the back member 30 is in a folded position. The drainage member 34, the leg support assembly 60, and the back member 30 are foldable such that the personal hygiene seat assembly 10 is foldable for facilitating transportation and storage of the personal hygiene seat assembly 10.

In use, the personal hygiene seat assembly is unfolded. The assembly is then strapped to a chair using the rear strap members and bottom strap. The seat member is inflated to the desired height. The user is then positioned on the assembly and secured using the first and second seat belt members. The leg support assembly is adjusted to support the legs and feet of the user. The user then may be shampooed, shaved or groomed as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A personal hygiene seat assembly comprising:

a base member adapted for removably coupling to a seat portion of a chair;

a back member hingedly coupled to said base member;

a seat member having a bottom portion and a backing portion, said bottom portion being adapted for supporting a person sitting on said personal hygiene seat assembly, said backing portion being adapted for supporting a back of the person using said personal hygiene seat assembly when the person is in a reclined position, said backing portion being coupled to said back member, said bottom portion being coupled to said base member.

2. The personal hygiene seat assembly of claim 1, further comprising:

a leg support assembly hingedly coupled to a front edge of said base member, said leg support assembly being adapted for supporting the legs of a user when the user is in a reclined position.

3. The personal hygiene seat assembly of claim 2, wherein said leg support assembly further comprises:

a leg support frame hingedly coupled to said front edge of said base member, said leg support frame being adapted for supporting the legs of the user when the user is in a reclined position;

a pair of extension members each having a first end and a second end, said first end being pivotally coupled to an underside of said base member, said second end being pivotally coupled to a backside of said leg support frame, said pair of extension members being for positioning said leg support frame such that a plane defined by said leg support frame is oriented at an oblique angle to a plane defined by said base member, said oblique angle being determinable by the user.

4. The personal hygiene seat assembly of claim 3, wherein said leg support assembly further comprises:

a foot rest portion pivotally coupled to said leg support frame, said foot rest portion being adapted for supporting the feet of a user when the user is in a seated or reclined position.

5. The personal hygiene seat assembly of claim 1, further comprising:

a plurality of rear strap members, each one of said rear strap members having a first end coupled to a first side of said back member, each one of said rear strap members having a second end, each second end being couplable to a second side of said back member for coupling said back member to a back portion of a seat such that said personal hygiene seat assembly is prevented from sliding forward on the seat when said plurality of rear strap members is placed around the back portion of the seat and coupled to said second side of said back member.

6. The personal hygiene seat assembly of claim 1, further comprising:

a bottom strap having a first end coupled to a first side of said base member, said bottom strap having a second end couplable to a second side of said base member, said bottom strap being adapted for fitting around a seat portion of a chair for preventing said personal hygiene seat assembly from being lifted off of the chair when said bottom strap is coupled to said second side of said base member.

7. The personal hygiene seat assembly of claim 1, wherein said drainage member further comprises a polymeric material for facilitating the flow of water and inhibiting the absorption of water by said drainage member.

8. The personal hygiene seat assembly of claim 1, further comprising:

a first seat belt member having a first end and a second end, said first end being coupled to a first side of said base member, said second end having a first portion of hook and loop fastener applied thereon;

a second seat belt member having a first end and a second end, said first end being coupled to a second side of said base member, said second end having a second complementary portion of hook and loop fastener applied thereon, said first and second seat belt members being adapted for securing a user to said personal hygiene seat assembly during use and preventing the user from slipping off of said seat assembly.

9. The personal hygiene seat assembly of claim 1, further comprising:

said seat member being inflatable for facilitating adjustment of the height of said seat member to align a top of said seat member with an edge of a sink.

10. The personal hygiene seat assembly of claim 9, further comprising:

an air inlet valve positioned on a side of said base member, said air inlet valve being in environmental communication with said inflatable seat member, said air inlet valve being for controlling the quantity of air in said inflatable seat member such that the height of said seat member is controllable by adjusting said air inlet valve.

11. The personal hygiene assembly of claim 1, further comprising:

wherein said seat member comprises a cover portion and a pad portion, said pad portion comprising foam rubber, said cover portion enveloping said pad portion, said cover portion comprising a substantially waterproof material for repelling moisture.

12. The personal hygiene assembly of claim 1, further comprising:

wherein said base member having a length of approximately 24 inches, a width of approximately 17 and ½ inches, and a thickness if approximately 4 inches.

13. The personal hygiene assembly of claim 1, further comprising:

wherein said backing portion of said seat member has a height of approximately 24 inches, said bottom portion having a length of approximately 24 inches, said seat member having a width of approximately 17 and ½ inches, said seat member having a thickness of approximately 4 inches.

14. A personal hygiene seat assembly comprising:

a base member adapted for removably coupling to a seat portion of a chair;

a back member hingedly coupled to said base member;

a seat member having a bottom portion and a backing portion, said bottom portion being adapted for supporting a person sitting on said personal hygiene seat assembly, said backing portion having a thickness measured from front to back of said backing portion, said thickness tapering from a base of said backing portion to a top of said backing portion whereby said backing portion is adapted for positioning the person using said personal hygiene seat assembly in a reclined position, said backing portion being coupled to said back member, said bottom portion being coupled to said base member;

a drainage member having a proximal edge and a distal edge, said proximal edge being hingedly coupled to a top edge of said back member for facilitating the flow of water into a sink when said personal hygiene assembly being placed adjacent to the sink;

said drainage member being structured to include a depression extending along a longitudinal axis of said drainage member, said depression having a uniform transverse cross-section extending along a length of said depression such that said depression is adapted for facilitating the flow of water into the sink, said depression having a width substantially equivalent to the size of a human head; and said top of said backing portion having a central depression, said central depression being aligned with said depression of said drainage member when said drainage member is in an extended position;

a leg support assembly hingedly coupled to a front edge of said base member, said leg support assembly being adapted for supporting the legs of a user when the user is in a reclined position;

a leg support frame hingedly coupled to said front edge of said base member, said leg support frame being adapted for supporting the legs of the user when the user is in a reclined position;

a pair of extension members each having a first end and a second end, said first end being pivotally coupled to an underside of said base member, said second end being pivotally coupled to a backside of said leg support frame, said pair of extension members being for positioning said leg support frame such that a plane defined by said leg support frame is oriented at an oblique angle to a plane defined by said base member, said oblique angle being determinable by the user;

a foot rest portion pivotally coupled to said leg support frame, said foot rest portion being adapted for supporting the feet of a user when the user is in a seated or reclined position;

a plurality of rear strap members, each one of said rear strap members having a first end coupled to a first side of said back member, each one of said rear strap members having a second end, each second end being couplable to a second side of said back member for coupling said back member to a back portion of a seat such that said personal hygiene seat assembly is prevented from sliding forward on the seat when said plurality of rear strap members is placed around the back portion of the seat and coupled to said second side of said back member;

a bottom strap having a first end coupled to a first side of said base member, said bottom strap having a second end couplable to a second side of said base member, said bottom strap being adapted for fitting around a seat portion of a chair for preventing said personal hygiene seat assembly from being lifted off of the chair when said bottom strap is coupled to said second side of said base member;

wherein said drainage member further comprises a polymeric material for facilitating the flow of water and inhibiting the absorption of water by said drainage member;

a first seat belt member having a first end and a second end, said first end being coupled to a first side of said base member, said second end having a first portion of hook and loop fastener applied thereon;

a second seat belt member having a first end and a second end, said first end being coupled to a second side of said base member, said second end having a second complementary portion of hook and loop fastener applied thereon;

said first and second seat belt members being adapted for securing a user to said personal hygiene seat assembly during use and preventing the user from slipping off of said seat assembly;

said seat member being inflatable for facilitating adjustment of the height of said seat member to align a top of said seat member with an edge of a sink;

an air inlet valve positioned on a side of said base member, said air inlet valve being in environmental communication with said inflatable seat member, said air inlet valve being for controlling the quantity of air in said inflatable seat member such that the height of said seat member is controllable by adjusting said air inlet valve;

wherein said seat member comprises a cover portion and a pad portion, said pad portion comprising foam rubber, said cover portion enveloping said pad portion, said cover portion comprising a substantially waterproof material for repelling moisture.

15. The personal hygiene assembly of claim 14, further comprising:

wherein said base member having a length of approximately 24 inches, a width of approximately 17 and ½ inches, and a thickness if approximately 4 inches.

16. The personal hygiene assembly of claim 15, further comprising:

wherein said backing portion of said seat member has a height of approximately 24 inches, said bottom portion having a length of approximately 24 inches, said seat member having a width of approximately 17 and ½ inches, said seat member having a thickness of approximately 4 inches.

17. The personal hygiene seat assembly of claim 14, further comprising:

said drainage member being foldable such that a bottom surface of said drainage member abuts a back surface of said back member when said drainage assembly is in a folded position;

said leg support assembly being foldable such that a back surface of said leg support assembly abuts a bottom surface of said base member when said leg support assembly is in a folded position;

said back member being foldable such that a front surface of said backing portion abuts a top surface of said bottom portion when said back member is in a folded position;

said drainage member, said leg support assembly, and said back member being foldable such that said personal hygiene seat assembly is foldable for facilitating transportation and storage of said personal hygiene seat assembly.

* * * * *